US008708716B1

(12) United States Patent
Ho

(10) Patent No.: US 8,708,716 B1
(45) Date of Patent: Apr. 29, 2014

(54) ELECTRICAL CONNECTOR

(71) Applicant: Lotes Co., Ltd., Keelung (TW)

(72) Inventor: Chien-Chih Ho, Keelung (TW)

(73) Assignee: Lotes Co., Ltd., Keelung (TW)

( * ) Notice: Subject to any disclaimer, the term of this patent is extended or adjusted under 35 U.S.C. 154(b) by 53 days.

(21) Appl. No.: 13/674,163

(22) Filed: Nov. 12, 2012

(51) Int. Cl.
*H01R 12/00* (2006.01)

(52) U.S. Cl.
USPC ..... 439/83

(58) Field of Classification Search
CPC . H01R 12/57; H01R 13/2442; H01R 43/0256
USPC ..... 439/66, 71, 83
See application file for complete search history.

(56) References Cited

U.S. PATENT DOCUMENTS

| | | | | |
|---|---|---|---|---|
| 6,533,590 | B1 * | 3/2003 | Lee et al. | 439/83 |
| 6,743,037 | B2 | 6/2004 | Kassa et al. | |
| 6,755,667 | B2 * | 6/2004 | Lin | 439/83 |
| 6,905,377 | B2 * | 6/2005 | Murr | 439/862 |
| 6,957,987 | B2 * | 10/2005 | Ma et al. | 439/733.1 |
| 7,059,873 | B2 * | 6/2006 | Johnescu et al. | 439/83 |
| 7,074,048 | B2 * | 7/2006 | Liao et al. | 439/66 |
| 7,140,886 | B1 * | 11/2006 | Chen | 439/83 |
| 7,264,486 | B2 * | 9/2007 | Ma | 439/83 |
| 7,278,864 | B2 * | 10/2007 | Tsai | 439/83 |
| 7,297,007 | B2 * | 11/2007 | Hao | 439/83 |
| 7,422,447 | B2 * | 9/2008 | Daily et al. | 439/83 |
| 7,429,179 | B2 * | 9/2008 | Ma | 439/83 |
| 7,682,165 | B2 * | 3/2010 | Liao | 439/83 |
| 7,771,244 | B1 * | 8/2010 | Ju | 439/857 |
| 7,791,443 | B1 * | 9/2010 | Ju | 336/107 |
| 7,828,562 | B2 * | 11/2010 | Wu | 439/83 |
| 7,878,870 | B2 * | 2/2011 | Fan | 439/862 |
| 7,922,548 | B2 * | 4/2011 | Fan | 439/862 |
| 8,033,834 | B2 * | 10/2011 | Polnyi et al. | 439/66 |
| 8,052,436 | B1 * | 11/2011 | Ju | 439/83 |
| 8,052,454 | B2 * | 11/2011 | Polnyi | 439/342 |
| 8,147,256 | B2 * | 4/2012 | Jin | 439/83 |
| 8,177,574 | B2 * | 5/2012 | Ju | 439/342 |
| 8,192,206 | B1 * | 6/2012 | Ju | 439/66 |
| 8,215,998 | B1 * | 7/2012 | Ju et al. | 439/660 |

(Continued)

FOREIGN PATENT DOCUMENTS

| | | |
|---|---|---|
| CN | 201590512 U | 9/2010 |
| CN | 201937059 U | 8/2011 |
| CN | 201994449 U | 9/2011 |
| CN | 202042630 U | 11/2011 |

*Primary Examiner* — Ross Gushi
(74) *Attorney, Agent, or Firm* — Morris Manning & Martin LLP; Tim Tingkang Xia, Esq.

(57) ABSTRACT

An electrical connector includes: an insulating body having a plurality of receiving holes disposed thereon, each receiving hole including a protrusion, and the protrusion includes a guiding surface and an abutting surface; a plurality of solder balls; and a plurality of terminals correspondingly received in the plurality of receiving holes. Each terminal includes a base correspondingly received in one of the receiving holes, an extending arm extending downwards from the base, a soldering portion extending from the extending arm, and an elastic arm extending upwards from the base. The soldering portion includes two clamping portions extending laterally to respectively clamp a periphery of the solder ball. At least a part of the soldering portion is positioned below the abutting surface of the protrusion of the receiving hole such that the part of the soldering portion abuts the abutting surface of the protrusion of the receiving hole.

11 Claims, 9 Drawing Sheets

(56) References Cited

U.S. PATENT DOCUMENTS

| | | | | |
|---|---|---|---|---|
| 8,221,172 | B2 * | 7/2012 | Ju et al. | 439/884 |
| 8,235,734 | B2 * | 8/2012 | Ju | 439/83 |
| 8,246,360 | B1 * | 8/2012 | Tsai et al. | 439/83 |
| 8,277,230 | B2 * | 10/2012 | Huo et al. | 439/66 |
| 8,323,038 | B2 * | 12/2012 | Jin | 439/83 |
| 8,360,790 | B2 * | 1/2013 | Ju | 439/83 |
| 8,414,311 | B2 * | 4/2013 | Ju | 439/83 |
| 8,491,337 | B2 * | 7/2013 | Cai | 439/607.28 |
| 8,608,491 | B2 * | 12/2013 | Hsu | 439/83 |
| 2003/0114029 | A1 * | 6/2003 | Lee et al. | 439/83 |
| 2003/0186571 | A1 * | 10/2003 | Lin | 439/83 |
| 2003/0203660 | A1 * | 10/2003 | Kassa et al. | 439/65 |
| 2004/0209492 | A1 * | 10/2004 | Kajinuma et al. | 439/71 |
| 2004/0266227 | A1 * | 12/2004 | Ma | 439/71 |
| 2005/0003684 | A1 * | 1/2005 | Huang | 439/71 |
| 2005/0054218 | A1 * | 3/2005 | Liao et al. | 439/66 |
| 2005/0287836 | A1 * | 12/2005 | Ju | 439/71 |
| 2006/0030180 | A1 * | 2/2006 | Tsai | 439/83 |
| 2006/0094268 | A1 * | 5/2006 | Hao | 439/83 |
| 2006/0116004 | A1 * | 6/2006 | Rathburn | 439/66 |
| 2006/0258190 | A1 * | 11/2006 | Chen | 439/83 |
| 2007/0249240 | A1 * | 10/2007 | Chiang | 439/850 |
| 2009/0088016 | A1 * | 4/2009 | Liao | 439/357 |
| 2009/0263985 | A1 * | 10/2009 | Liu et al. | 439/66 |
| 2010/0081329 | A1 * | 4/2010 | Fan | 439/626 |
| 2010/0267257 | A1 * | 10/2010 | Yeh et al. | 439/83 |
| 2011/0008979 | A1 * | 1/2011 | Yeh et al. | 439/83 |
| 2011/0111638 | A1 * | 5/2011 | Cheng | 439/660 |
| 2012/0028502 | A1 * | 2/2012 | Yeh et al. | 439/626 |
| 2012/0171897 | A1 * | 7/2012 | Ju et al. | 439/607.01 |
| 2012/0178298 | A1 * | 7/2012 | Jin | 439/626 |
| 2013/0183861 | A1 * | 7/2013 | Chang et al. | 439/607.35 |

* cited by examiner

200

230

ELECTRICAL CONNECTOR

FIELD OF THE INVENTION

The present invention relates to an electrical connector, and more particularly to an electrical connector for electrically connecting an integrated circuit (IC) chip module to a circuit board.

BACKGROUND OF THE INVENTION

Currently, an electrical connector commonly used in the field includes an insulating body, a plurality of conductive terminals, and a plurality of solder balls. The insulating body is disposed with a plurality of receiving holes corresponding to the conductive terminals and the solder balls. Each conductive terminal has a base fixed in one of the receiving holes, and a solder portion having two clamping portions respectively extending from the base towards two sides thereof, where the two clamping portions approach each other in a shape of a circle. Each solder ball is correspondingly clamped between the two clamping portions of the corresponding conductive terminal.

However, in the electrical connector, the clamping portions of the solder portion are positioned in the corresponding receiving hole such that there is no structure to fix the position of the clamping portions. Therefore, when the solder ball is disposed between the two clamping portions, the clamping portions may be deformed or broken such that the conductive terminal is damaged, thus losing the clamping and positioning effects on the solder ball, such that the solder ball has a poor soldering effect, even missing solder.

Therefore, a heretofore unaddressed need exists in the art to address the aforementioned deficiencies and inadequacies.

SUMMARY OF THE INVENTION

In one aspect, the invention is directed to an electrical connector. In one embodiment, the electrical connector includes an insulating body, a plurality of solder balls, and a plurality of terminals. The insulating body has a plurality of receiving holes disposed thereon. Each receiving hole includes a protrusion, and the protrusion includes a guiding surface and an abutting surface. The solder balls are correspondingly received in one of the receiving holes respectively. The terminals are correspondingly received in the plurality of receiving holes. Each terminal includes a base correspondingly received in one of the receiving holes, an extending arm extending downwards from the base, a soldering portion extending from the extending arm, and an elastic arm extending upwards from the base. The soldering portion includes two clamping portions extending laterally to be located at two opposite sides of a vertical center line of the solder ball to respectively clamp a periphery of the solder ball under a horizontal center line of the solder ball, such that the solder ball is located between the two clamping portions, and a guiding portion corresponding to the guiding surface of the protrusion of the receiving hole. At least a part of the soldering portion is positioned below the abutting surface of the protrusion of the receiving hole such that the part of the soldering portion abuts the abutting surface of the protrusion of the receiving hole.

In one embodiment, the base of each terminal leans on a first inner side wall of the corresponding receiving hole, the protrusion of the corresponding receiving hole is formed on a second inner side wall opposite to the first inner side wall, and the extending arm bends from the base towards the second inner side wall and extends back towards the first inner side wall. In a further embodiment, the two clamping portions extend laterally towards the second inner side wall. In a further embodiment, each receiving hole has a passage space formed on the first inner side wall of the receiving hole, wherein when the guiding portion of the soldering portion of the terminal abuts the guiding surface of the protrusion of the receiving hole, the extending arm of the terminal is deformed towards the first inner side wall such that the soldering portion is received in the passage space and does not contact the first inner side wall of the receiving hole.

In one embodiment, the base of each terminal leans on a first inner side wall of the corresponding receiving hole, the protrusion of the corresponding receiving hole is formed on the first inner side wall, and the extending arm extends from the base toward a second inner side wall of the corresponding receiving hole opposite to the first inner side wall. In a further embodiment, the two clamping portions extend laterally towards the first inner side wall. In a further embodiment, each receiving hole has a passage space formed on the second inner side wall of the receiving hole, wherein when the guiding portion of the soldering portion of the terminal abuts the guiding surface of the protrusion of the receiving hole, the extending arm of the terminal is deformed towards the second inner side wall such that the soldering portion is received in the passage space and does not contact the second inner side wall of the receiving hole.

In one embodiment, a lateral width of the extending arm is less than a lateral width of the receiving hole.

In one embodiment, a lateral width of the elastic arm is greater than a lateral width of the receiving hole.

In one embodiment, the guiding surface of the protrusion is a slant surface.

In one embodiment, the guiding surface of the protrusion is a curved surface.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
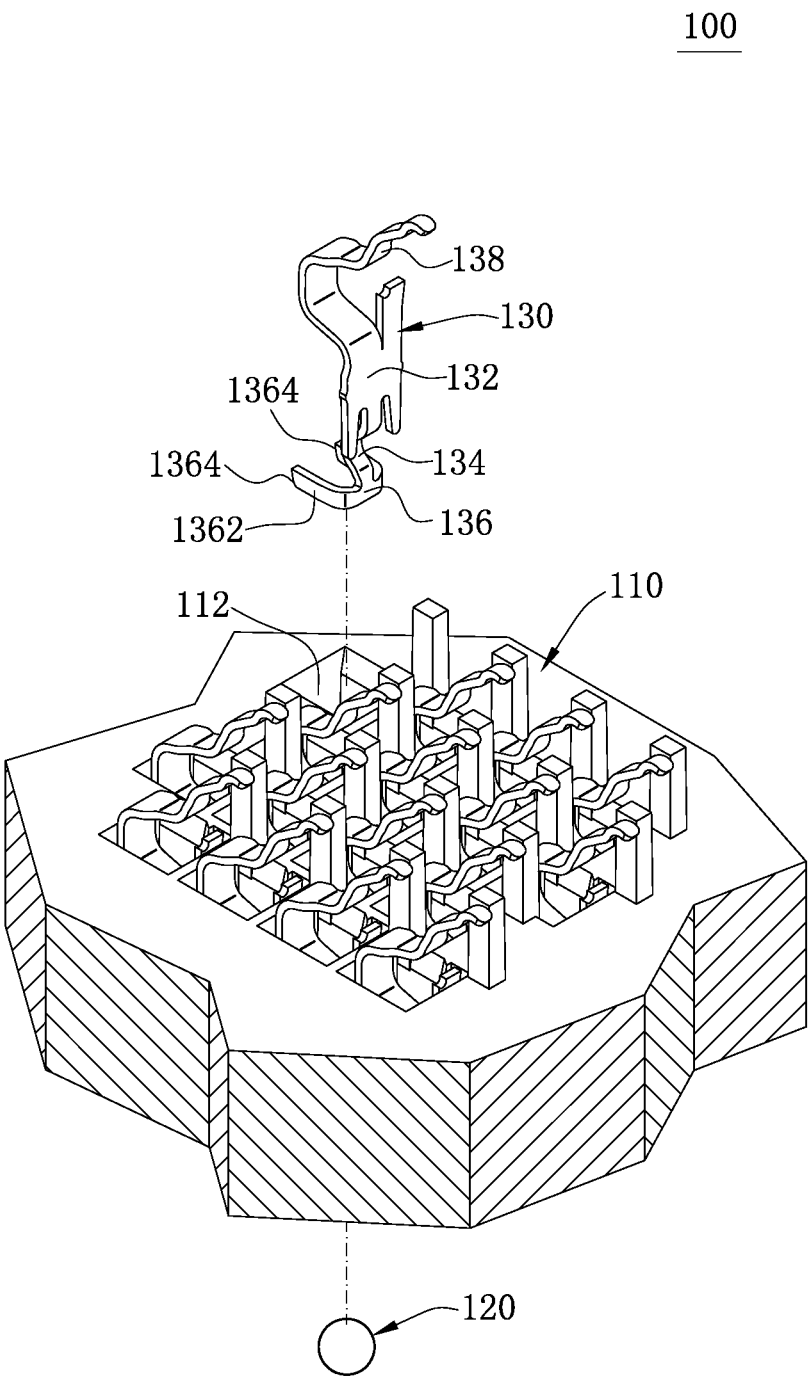
FIG. 1 shows schematically a partially exploded view of an electrical connector according to one embodiment of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. It will be appreciated that same thing can be said in more than one way. Consequently, alternative language and synonyms may be used for any one or more of the terms discussed herein, nor is any special significance to be placed upon whether or not a term is elaborated or discussed herein. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top", may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper", depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The description will be made as to the embodiments of the present invention in conjunction with the accompanying drawings in FIGS. 1-5. In accordance with the purposes of this invention, as embodied and broadly described herein, this invention, in one aspect, relates to an electrical connector.

Referring to FIG. 1, a partially exploded view of an electrical connector is schematically shown according to one embodiment of the present invention. In this exemplary embodiment, the electrical connector 100 includes an insulating body 110, a plurality of solder balls 120, and a plurality of terminals 130. The insulating body 110 has a plurality of receiving holes 112 defined therein. Each of the receiving holes 112 is configured to correspondingly receive one of the terminals 130 and one of the solder balls 120. As shown in FIG. 1, the insulating body 110 includes sixteen (16) receiving holes 112 arranged in four rows, with each row having four receiving holes 112. The receiving holes 112 are configured to receive the corresponding solder balls 120 and terminals 130. It should be appreciated that other numbers of the receiving holes, and the corresponding numbers of the solder balls and terminals can also be utilized to practice the present invention.

Figure 2A:
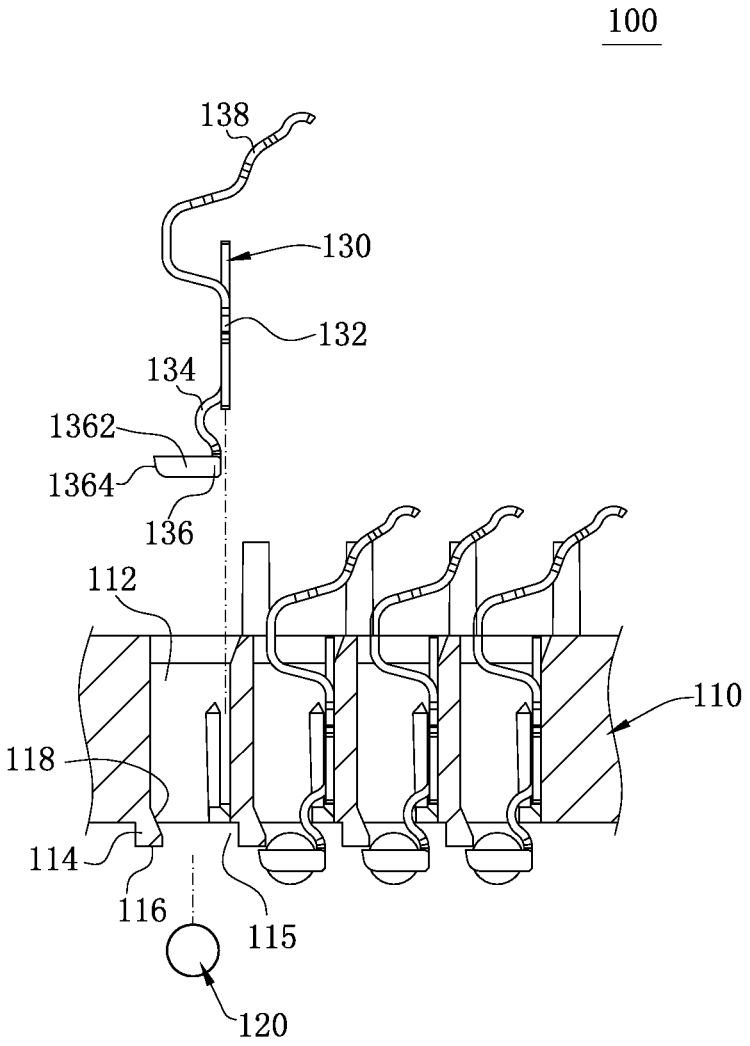
FIG. 2A shows schematically a cross-sectional exploded view of an electrical connector according to one embodiment of the present invention.
Figure 2B:
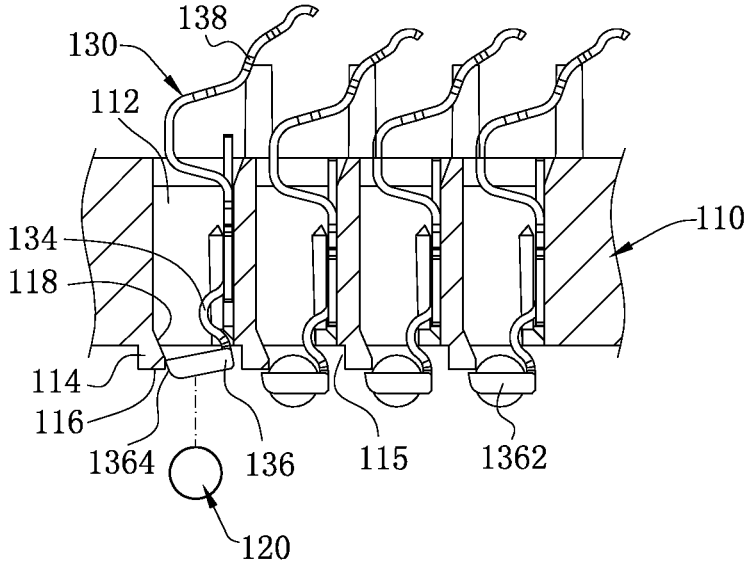
FIG. 2B shows schematically a cross-sectional view of an electrical connector according to one embodiment of the present invention, where the terminal is partially received in the insulating body.

FIG. 2A shows schematically a cross-sectional, exploded view of the electrical connector 100 as shown in FIG. 1. FIG. 2B schematically a cross-sectional views of the electrical connector 100, where one terminal 130 (the most left one in the figure) is partially received in one receiving holes 112 of the insulating body 110. As shown in FIGS. 2A and 2B, four receiving holes 112 in the same row are shown in the cross-section of the insulating body 110. To better illustrate the detailed structures of the receiving holes 112 and the terminals 130, one receiving hole 112 (most left one in FIGS. 2A and 2B) does not fully receive the corresponding solder ball 120 and terminal 130.

As shown in FIG. 2A, each receiving hole 112 includes a protrusion 114 at the lower half of the receiving hole 112 for securing the terminal 130 and the solder ball 120. The protrusion 114 includes a guiding surface 118 and an abutting surface 116. As shown in FIG. 2A, the guiding surface 118 is a slant surface. In certain embodiments, the guiding surface 118 may be a curved surface.

Each terminal 130 includes a base 132, an extending arm 134, a soldering portion 136, and an elastic arm 138. As shown in FIG. 2A, the base 132 is correspondingly received in one of the receiving holes 112. The extending arm 134 extends downwards from the base 132, and the elastic arm 138 extends upwards from the base 132. The soldering portion 136 extends from the extending arm 134. In certain embodiments, a lateral width of the extending arm 134 is less than a lateral width of the receiving hole 112 such that the extending arm 134 may be fully received in the receiving hole 112, and a lateral width of the elastic arm 138 is greater than a lateral width of the receiving hole 112 such that the elastic arm 138 does not enter the receiving hole 112 to fix the position of the terminal 130 and to prevent the terminal 130 from passing downwards through the receiving hole 112.

As shown in FIG. 2A, the base 132 of each terminal 130 leans on a first inner side wall (the right inner side wall) of the corresponding receiving hole 112. The protrusion 114 of the corresponding receiving hole 112 is formed on a second inner side wall (the left inner side wall) opposite to the first inner side wall. Further, the extending arm 134 bends from the base 132 towards the second inner side wall and extends back towards the first inner side wall, forming a C-shaped bending arm. The extending arm 134 is elastic to enable deformation in the installing process of the terminal 130. Thus, the soldering portion 136 extends from the extending arm 134 toward the second inner side wall.

Figure 3A:
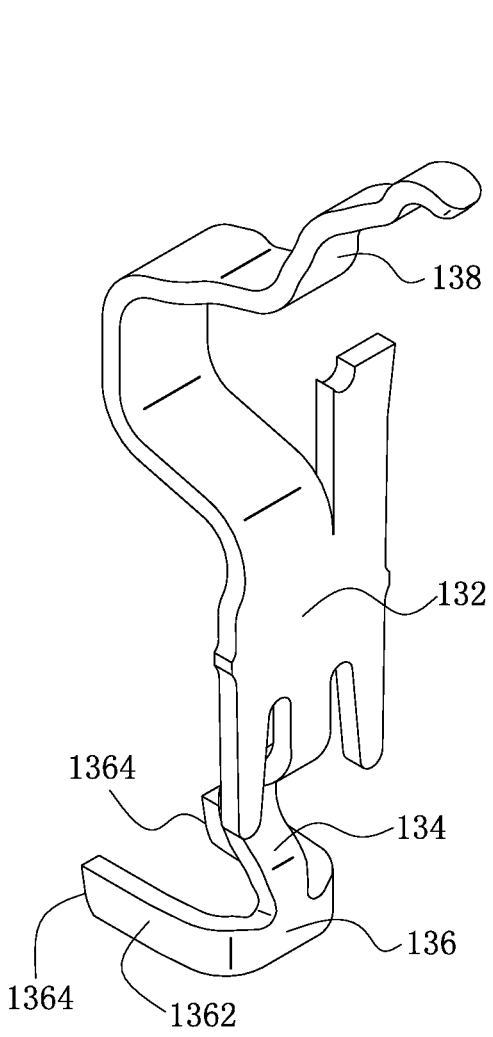
FIG. 3A shows schematically a perspective view of a terminal according to one embodiment of the present invention.
Figure 3B:
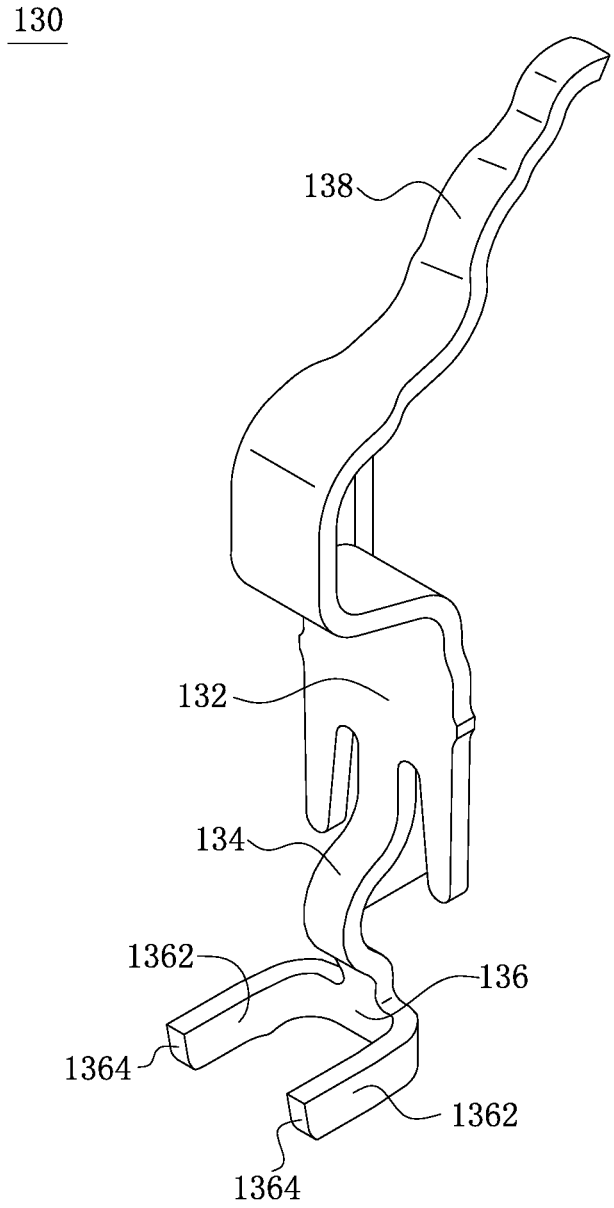
FIG. 3B shows schematically another perspective view of the terminal shown in FIG. 3A.

FIGS. 3A and 3B show schematically two perspective views of a terminal 130 according to one embodiment of the present invention. As shown in FIGS. 3A and 3B, the soldering portion 136 includes two clamping portions 1362 extending laterally towards the second inner side wall. Thus, a clamping space is formed between the two clamping portions 1362, such that the solder ball 120 may be located in the clamping space between the two clamping portions 1362, and the two clamping portions 1362 may be located at two opposite sides of a vertical center line of the solder ball 120 to respectively clamp a periphery of the solder ball 120 under a horizontal center line of the solder ball 120. In addition, as assembled, the C-shaped bending arm of the extending arm 134 and the protrusion 114 may be against the solder ball 120 so as to prevent the solder ball 120 from moving. Further, at the end of each clamping portions 1362, a guiding portion 1364 is provided to correspond to the guiding surface 118 of the protrusion 114 of the receiving hole 112. The guiding portion 1364 may be a slant surface or a curved surface corresponding to the guiding surface 118 of the protrusion 114.

Referring back to FIGS. 2A and 2B, at least a part of the soldering portion 136 (the upper part of the end of the clamping portions 1362 as shown in FIG. 3) is positioned below the abutting surface 116 of the protrusion 114 of the receiving hole 112. Thus, when the terminal 130 is fully received in the receiving hole 112, the part of the soldering portion 136 abuts the abutting surface 116 such that the position of the terminal 130 is fixed to prevent the terminal 130 from passing upwards through the receiving hole 112.

Further, as shown in FIGS. 2A and 2B, each receiving hole 112 has a passage space 115 formed on the first inner side wall of the receiving hole 112. As shown in FIG. 2B, when the terminal 130 is installed in the receiving hole 112 from upper to lower, the guiding portion 1364 of the soldering portion 136 of the terminal 130 abuts the guiding surface 118 of the protrusion 114 of the receiving hole 112 to guide the terminal 130 to be inserted in the receiving hole 112. When the guiding portion 1364 abuts the guiding surface 118, the extending arm 134 (the C-shaped bending arm) of the terminal 130 is deformed and bent towards the first inner side wall of the receiving hole 112, such that the soldering portion 136 is received in the passage space 115 of the receiving hole 112 and does not contact the first inner side wall of the receiving hole 112. Thus, the soldering portion 136 does not bump to the first inner side wall of the receiving hole 112, which reduces the chance of damage of the soldering portion 136.

Figure 4A:
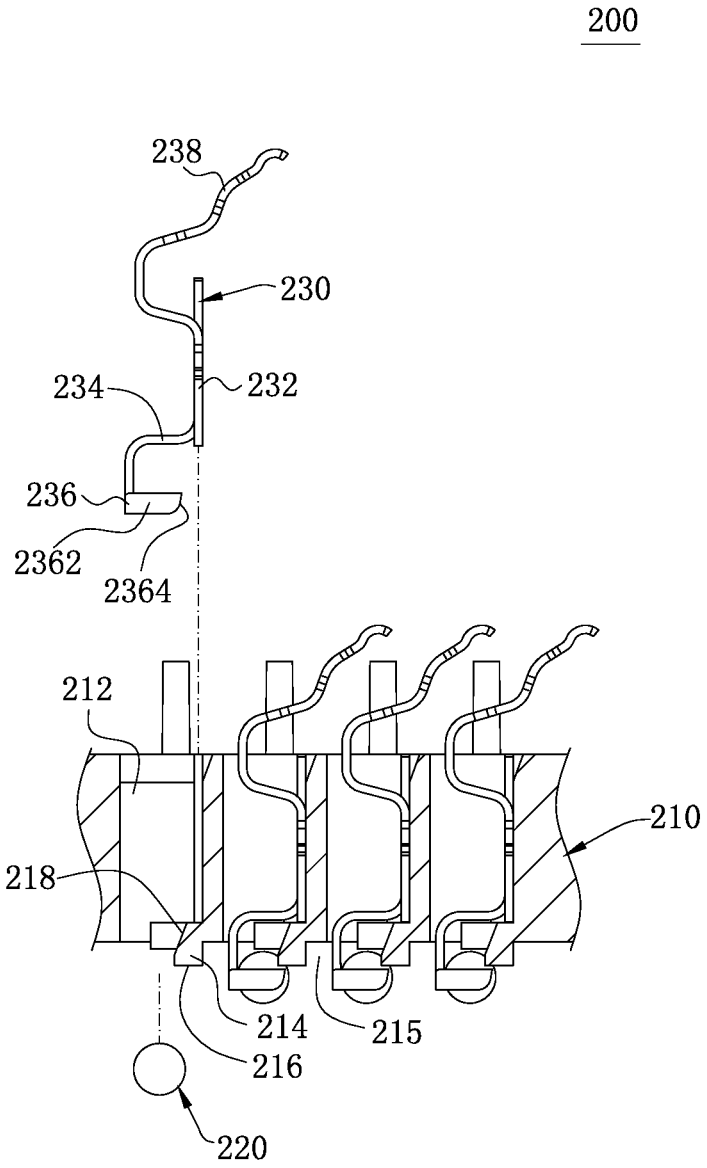
FIG. 4A shows schematically a cross-sectional exploded view of an electrical connector according to one embodiment of the present invention.
Figure 4B:
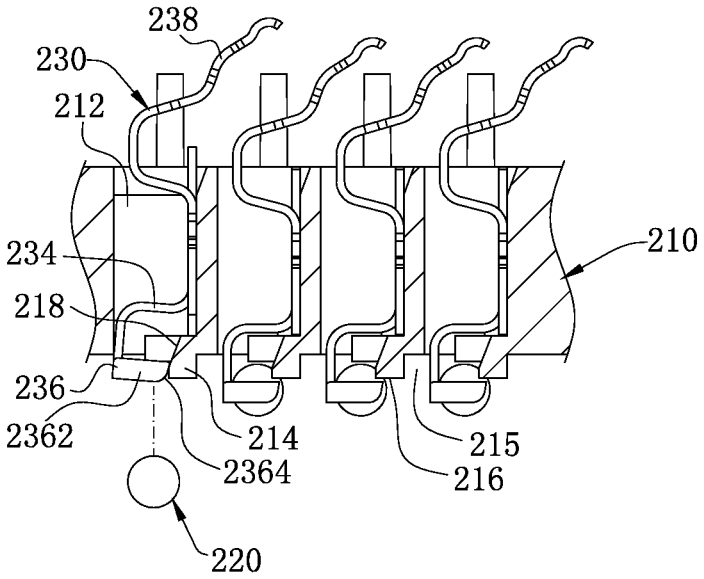
FIG. 4B shows schematically a cross-sectional view of an electrical connector according to one embodiment of the present invention, where the terminal is partially received in the insulating body.

Referring to FIGS. 4A and 4B, an electrical connector 200 is schematically shown according to another embodiment of the present invention. FIG. 4A shows schematically a cross-sectional exploded view of the electrical connector 200, while FIG. 4B shows schematically a cross-sectional view of the electrical connector 200, where the terminal is partially received in the insulating body. As shown in FIGS. 4A and 4B, four receiving holes 212 in the same row are shown in the cross-section of the insulating body 210. The receiving holes 212 are configured to receive the corresponding solder balls 220 and terminals 230. To better illustrate the detailed structures of the receiving holes 212 and the terminals 230, one receiving hole 212 (the most left one shown in FIGS. 4A and 4B) does not fully receive the corresponding solder ball 220 and terminal 230. It should be appreciated that other numbers of the receiving holes, and the corresponding numbers of the solder balls and terminals can also be utilized to practice the present invention.

As shown in FIG. 4A, each receiving hole 212 includes a protrusion 214 at the lower half of the receiving hole 212 for securing the terminal 230 and the solder ball 220. The protrusion 214 includes a guiding surface 218 and an abutting surface 216. As shown in FIG. 4A, the guiding surface 218 is a slant surface. In certain embodiments, the guiding surface 218 may be a curved surface.

Each terminal 230 includes a base 232, an extending arm 234, a soldering portion 236, and an elastic arm 238. As shown in FIG. 4A, the base 232 is correspondingly received in one of the receiving holes 212. The extending arm 234 extends downwards from the base 232, and the elastic arm 238 extends upwards from the base 232. The soldering portion 236 extends from the extending arm 234. In certain embodiments, a lateral width of the extending arm 234 is less than a lateral width of the receiving hole 212 such that the extending arm 234 may be fully received in the receiving hole 212, and a lateral width of the elastic arm 238 is greater than a lateral width of the receiving hole 212 such that the elastic arm 238 does not enter the receiving hole 212 to fix the position of the terminal 230 and to prevent the terminal 230 from passing downwards through the receiving hole 212.

As shown in FIG. 4A, the base 232 of each terminal 230 leans on a first inner side wall (the right inner side wall) of the corresponding receiving hole 212. The protrusion 214 of the corresponding receiving hole 212 is also formed on the first inner side wall. Further, the extending arm 234 extends from the base 232 and bends towards a second inner side wall (the left inner side wall) opposite to the first inner side wall, forming a substantially lateral extending arm. The extending arm 234 is elastic to enable deformation in the installing process of the terminal 230. Thus, the soldering portion 236 extends from the extending arm 234 toward the first inner side wall.

Figure 5A:
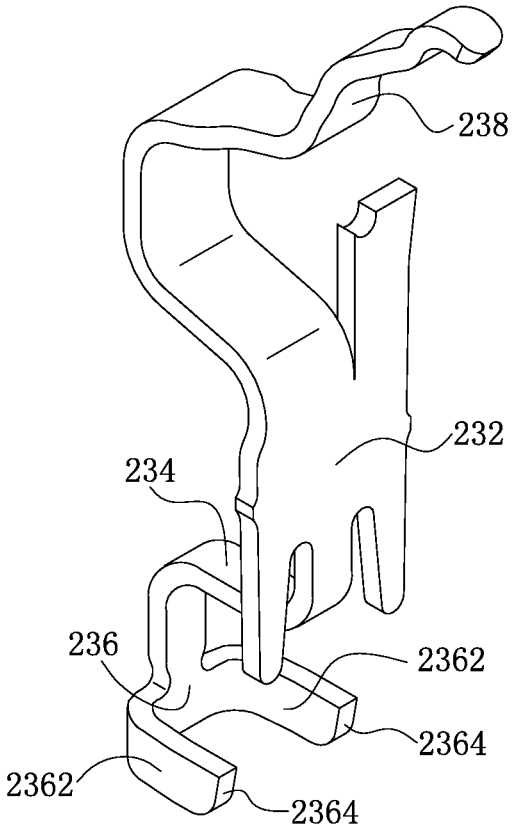
FIG. 5A shows schematically a perspective view of a terminal according to one embodiment of the present invention.
Figure 5B:
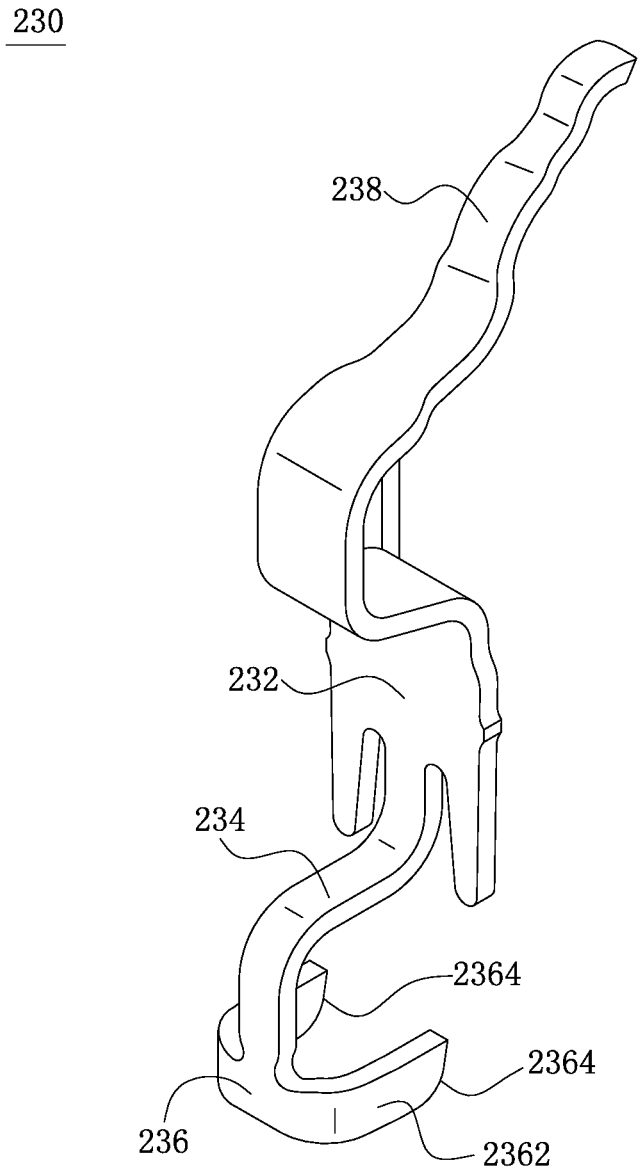
FIG. 5B shows schematically another perspective view of the terminal shown in FIG. 5A.

FIGS. 5A and 5B show schematically two perspective views of a terminal according to one embodiment of the present invention. As shown in FIGS. 5A and 5B, the soldering portion 236 includes two clamping portions 2362 extending laterally towards the first inner side wall. Thus, a clamping space is formed between the two clamping portions 2362, such that the solder ball 220 may be located in the clamping space between the two clamping portions 2362, and the two clamping portions 2362 may be located at two opposite sides of a vertical center line of the solder ball 220 to respectively clamp a periphery of the solder ball 220 under a horizontal center line of the solder ball 220. In addition, as assembled, the extending arm 234 and the protrusion 214 may be against the solder ball 220 so as to prevent the solder ball 220 from moving. Further, at the end of each clamping portions 2362, a guiding portion 2364 is provided to correspond to the guiding surface 218 of the protrusion 214 of the receiving hole 212. The guiding portion 2364 may be a slant surface or a curved surface corresponding to the guiding surface 218 of the protrusion 214.

Referring back to FIGS. 4A and 4B, at least a part of the soldering portion 236 (the upper part of the end of the clamping portions 2362 as shown in FIG. 5) is positioned below the abutting surface 216 of the protrusion 214 of the receiving hole 212. Thus, when the terminal 230 is fully received in the receiving hole 212, the part of the soldering portion 236 abuts the abutting surface 216 such that the position of the terminal 230 is fixed to prevent the terminal 230 from passing upwards through the receiving hole 212.

Further, as shown in FIGS. 4A and 4B, each receiving hole 212 has a passage space 215 formed on the second inner side wall of the receiving hole 212. As shown in FIG. 4B, when the terminal 230 is installed in the receiving hole 212, the guiding portion 2364 of the soldering portion 236 of the terminal 230 abuts the guiding surface 218 of the protrusion 214 of the receiving hole 212 to guide the terminal 230 to be inserted in the receiving hole 212. When the guiding portion 2364 abuts the guiding surface 218, the extending arm 234 (the lateral extending arm) of the terminal 230 is deformed and bent upwards and to the left, such that the soldering portion 236 moves toward the second inner side wall of the receiving hole 212 and is received in the passage space 215 of the receiving hole 212 and does not contact the second inner side wall of the receiving hole 212. Thus, the soldering portion 236 does not bump to the first inner side wall of the receiving hole 212, which reduces the chance of damage of the soldering portion 236.

In sum, with the corresponding protrusions of the receiving holes and the soldering portions of the terminals, the electrical connector according to the invention has the beneficial effect of fixing the positions of the terminals such that the terminals do not pass upwards through the receiving holes. Thus, when the solder ball is disposed between the two clamping portions of the soldering portion, the fixed position of the terminal may ensure the soldering process to be smoothly performed, such that the clamping portions would not be deformed or broken to damage the terminal, and the clamping and positioning effects on the solder ball may be maintained.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body having a plurality of receiving holes defined therein, wherein each receiving hole comprises a protrusion, and the protrusion comprises a guiding surface and an abutting surface;

a plurality of solder balls, correspondingly received in one of the receiving holes respectively; and a plurality of terminals correspondingly received in the plurality of receiving holes, wherein each terminal comprises a base correspondingly received in one of the receiving holes, an extending arm extending downwards from the base, a soldering portion extending from the extending arm, and an elastic arm extending upwards from the base, wherein the soldering portion comprises two clamping portions extending laterally to be located at two opposite sides of a vertical center line of the solder ball to respectively clamp a periphery of the solder ball under a horizontal center line of the solder ball, such that the solder ball is located between the two clamping portions, and a guiding portion corresponding to the guiding surface of the protrusion of the receiving hole, and wherein at least a part of the soldering portion is positioned below the abutting surface of the protrusion of the receiving hole such that the part of the soldering portion abuts the abutting surface of the protrusion of the receiving hole.

2. The electrical connector according to claim 1, wherein the base of each terminal leans on a first inner side wall of the corresponding receiving hole, the protrusion of the corresponding receiving hole is formed on a second inner side wall opposite to the first inner side wall, and the extending arm bends from the base towards the second inner side wall and extends back towards the first inner side wall.

3. The electrical connector according to claim 2, wherein the two clamping portions extend laterally towards the second inner side wall.

4. The electrical connector according to claim 2, wherein each receiving hole has a passage space formed on the first inner side wall of the receiving hole, wherein when the guiding portion of the soldering portion of the terminal abuts the guiding surface of the protrusion of the receiving hole, the extending arm of the terminal is deformed towards the first inner side wall such that the soldering portion is received in the passage space and does not contact the first inner side wall of the receiving hole.

5. The electrical connector according to claim 1, wherein the base of each terminal leans on a first inner side wall of the corresponding receiving hole, the protrusion of the corresponding receiving hole is formed on the first inner side wall, and the extending arm extends from the base toward a second inner side wall of the corresponding receiving hole opposite to the first inner side wall.

6. The electrical connector according to claim 5, wherein the two clamping portions extend laterally towards the first inner side wall.

7. The electrical connector according to claim 5, wherein each receiving hole has a passage space formed on the second inner side wall of the receiving hole, wherein when the guiding portion of the soldering portion of the terminal abuts the guiding surface of the protrusion of the receiving hole, the extending arm of the terminal is deformed towards the second inner side wall such that the soldering portion is received in the passage space and does not contact the second inner side wall of the receiving hole.

8. The electrical connector according to claim 1, wherein a lateral width of the extending arm is less than a lateral width of the receiving hole.

9. The electrical connector according to claim 1, wherein a lateral width of the elastic arm is greater than a lateral width of the receiving hole.

10. The electrical connector according to claim 1, wherein the guiding surface of the protrusion is a slant surface.

11. The electrical connector according to claim 1, wherein the guiding surface of the protrusion is a curved surface.

* * * * *